US007182405B1

(12) United States Patent
Blakeslee

(10) Patent No.: US 7,182,405 B1
(45) Date of Patent: Feb. 27, 2007

(54) CHAIR WITH REMOVABLE SLING

(75) Inventor: Stanton E. Blakeslee, Greenville, NC (US)

(73) Assignee: Freddy & Friends, LLC, Greenville, NC (US)

( * ) Notice: Subject to any disclaimer, the term of this patent is extended or adjusted under 35 U.S.C. 154(b) by 0 days.

(21) Appl. No.: 11/199,973

(22) Filed: Aug. 9, 2005

(51) Int. Cl.
*A47C 7/02* (2006.01)

(52) U.S. Cl. ..... 297/452.13; 297/271.6; 297/440.11

(58) Field of Classification Search ..... 297/258.1, 297/271.5, 452.56, 440.11, 452.13, 181, 271.6, 297/452.63, 452.64, 452.12, 45
See application file for complete search history.

(56) References Cited

U.S. PATENT DOCUMENTS

| | | | | |
|---|---|---|---|---|
| 912,216 | A | 2/1909 | Wells | |
| 1,228,967 | A | 6/1917 | Rho | |
| 1,422,915 | A * | 7/1922 | Benson et al. | 160/352 |
| 1,949,282 | A | 2/1934 | Murray | |
| 2,052,955 | A | 9/1936 | Venderminden | |
| 3,123,379 | A * | 3/1964 | Stocking | 280/282 |
| 3,123,396 | A | 3/1964 | Searle | |
| 3,650,563 | A * | 3/1972 | Hansson et al. | 297/440.11 |
| 3,985,460 | A * | 10/1976 | Piper et al. | 403/234 |
| 4,118,064 | A | 10/1978 | Robeson | |
| 4,252,367 | A | 2/1981 | Vanderminden | |
| 5,054,849 | A | 10/1991 | Hoff | |
| 5,476,308 | A | 12/1995 | St. Germain | |
| 5,636,897 | A * | 6/1997 | Zapf | 297/228.1 |
| 5,690,379 | A * | 11/1997 | Cayssials | 297/118 |
| 5,735,578 | A | 4/1998 | Penley | |
| 6,106,056 | A | 8/2000 | Wegner | |
| 6,257,660 | B1 | 7/2001 | Calvey | |
| 6,669,280 | B1 | 12/2003 | Wegner | |
| 6,695,408 | B1 * | 2/2004 | Nobbe | 297/440.11 |

OTHER PUBLICATIONS

John Barkand and Nikki Holbrook Handmade Chair, Artwork, 1990, 1 Pg, US.

* cited by examiner

*Primary Examiner*—Milton Nelson, Jr.
(74) *Attorney, Agent, or Firm*—MacCord Mason PLLC

(57) ABSTRACT

A chair is constructed of a chair frame having spaced, parallel side members with rear ends and outwardly curved front ends, a first horizontal seat support extending between the side members adjacent their rear ends, and a second horizontal seat support parallel to and in a plane below the first support extending between the side members adjacent their front ends; and a sling seat in the form of a continuous loop of textile material extending around the first and second supports to form a seating surface, the loop being removable from the chair frame without separating the loop by pulling the loop around the front end of one of the side members for placement while the loop is supported on the first seat support.

19 Claims, 4 Drawing Sheets

CHAIR WITH REMOVABLE SLING

BACKGROUND OF THE INVENTION

1. Field of the Invention

The present invention relates to a chair, and in particular to a chair of the type known as a sling chair, having a seating surface in the form of a flexible loop of material that is removable without disconnecting the loop.

2. Description of the Prior Art

A sling chair, or deck chair, is often used for casual seating and is comprised of a support frame configured to support a strip of material that is used as the chair's seating surface, i.e., the seat and back surface contacted by the user when seated. The support frame is often hinged so that the chair can be folded for storage and/or transportation.

The chair support frame of these prior art chairs normally includes a first sling support adjacent the upper back of the chair frame and a second sling support adjacent the front of the seating area of the chair. The sling in the form of a single layer of material extends between these supports, with each end of the sling being individually looped around one of the supports and secured in place, e.g., by sewing or with snaps or other releasable fasteners.

The sling length is greater than the distance between the two supports so that, when the user sits on the sling, the sling will take a curved shape, with the lower part of the curve forming the seat and the upper part of the curve forming the back of the seating surface. Replacement of the seating on conventional sling chairs is impractical or at least difficult, requiring removal of the stitching or opening of the fasteners, which often become rusted and unusable after a period of time, particularly if the sling is laundered or recovered.

Thus, there is a need for a sling chair construction, and in particular a non-folding sling chair construction that facilitates ease of positioning and removal of the sling without the need to remove stitches or use releasable fasteners. There is a further need for a sling that will provide a greater wear-life before replacement is required. There is a further need for a chair that includes a reversible sling.

SUMMARY OF THE INVENTION

These needs are addressed in the present invention by providing a non-folding sling chair in which the sling or seating surface is comprised of a continuous loop of flexible material, with the chair frame being constructed in a manner that permits installation and removal of the sling without cutting or otherwise opening the loop.

Specifically, the present invention is comprised of a fixed, i.e., non-folding, chair frame and a sling seat in the form of a continuous or closed loop. The chair frame has spaced, parallel side members with first and second ends, a first seat support extending between the side members adjacent their first ends, and a second seat support parallel to the first support extending between the side members adjacent their second ends. The sling loop extends around the first and second supports to form a seating surface.

The loop is also sized, and the chair frame configured, so that the loop can be removed from the chair without separating the loop by pulling the loop around an end of one of the side members while the loop is held by the support member adjacent the other end of the chair. For example, the chair frame can be constructed of a pair of spaced, parallel side members that serve to support the chair on the floor. The side members will normally include a back end that extends upwardly to an upper end, and a front end spaced from the back end. The upper surfaces of the side panels between the front and back ends may serve as arm rests.

The chair frame also includes two horizontal support members to attach the side members together and to serve as supports for the seat support loop. One of the support members, the rear support member, extends between the upper rear ends of the side members, while the other support member, the front support member, extends between the side members adjacent their front ends. The rear support member is in a plane above the front support member so that the sling will form a seat support and a back support when in use. The support members are preferably cylindrical to facilitate rotation of the sling about the supports. In order to facilitate placement and removal of the sling, the two horizontal support members are preferably the sole means of joining the two side members.

The circumference of the loop relative to the dimensions of the chair will vary dependent on various factors, including the distance between the horizontal supports, the profile of the chair side members, the width of the loop, the diameter of the side members, and the position of the horizontal supports on the side members. Adjustment of the loop circumference to take these factors into account is within the capabilities of one skilled in the art. All that is required is that the circumference of the loop is sufficient to allow the loop to slide over one end of a side member, e.g., the rear end of a side member, while the loop is around the horizontal support at the opposite end of the side support, e.g., the front end.

The loop, of course should be of a sufficient circumference relative to the chair dimension that the loop will assume a curved shape with a seating area and a back support area when the user is seated. Due to the fact that the periphery of each horizontal support is significantly smaller than the periphery of the side member, this result will normally be achieved when the loop is of a size permitting removal over an end of a side member. It is not required that the loop be removable over either end of the chair side member, so long as it is removable over one end of the side member. In fact, the design of most chair frames will be such that the loop will be removable over the rear end of a side member, but not over the front of the side member.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation.

The drawings are for the purpose of illustrating the invention and are not intended to be to scale.

Figure 1:
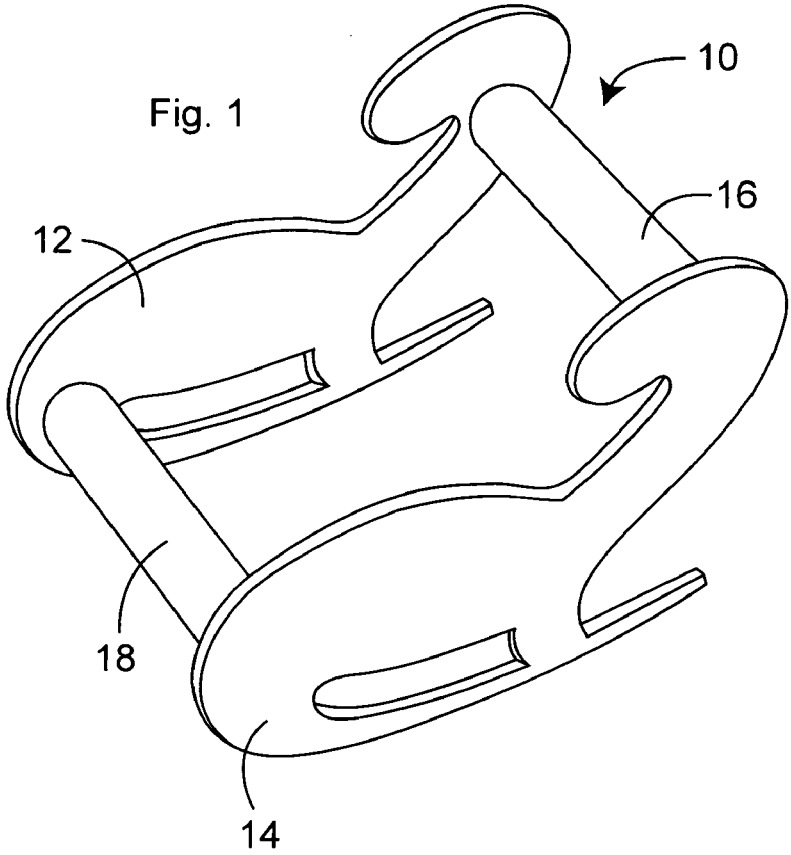
FIG. 1 is a perspective view of a chair frame, shown as a rocking chair.
Figure 7:
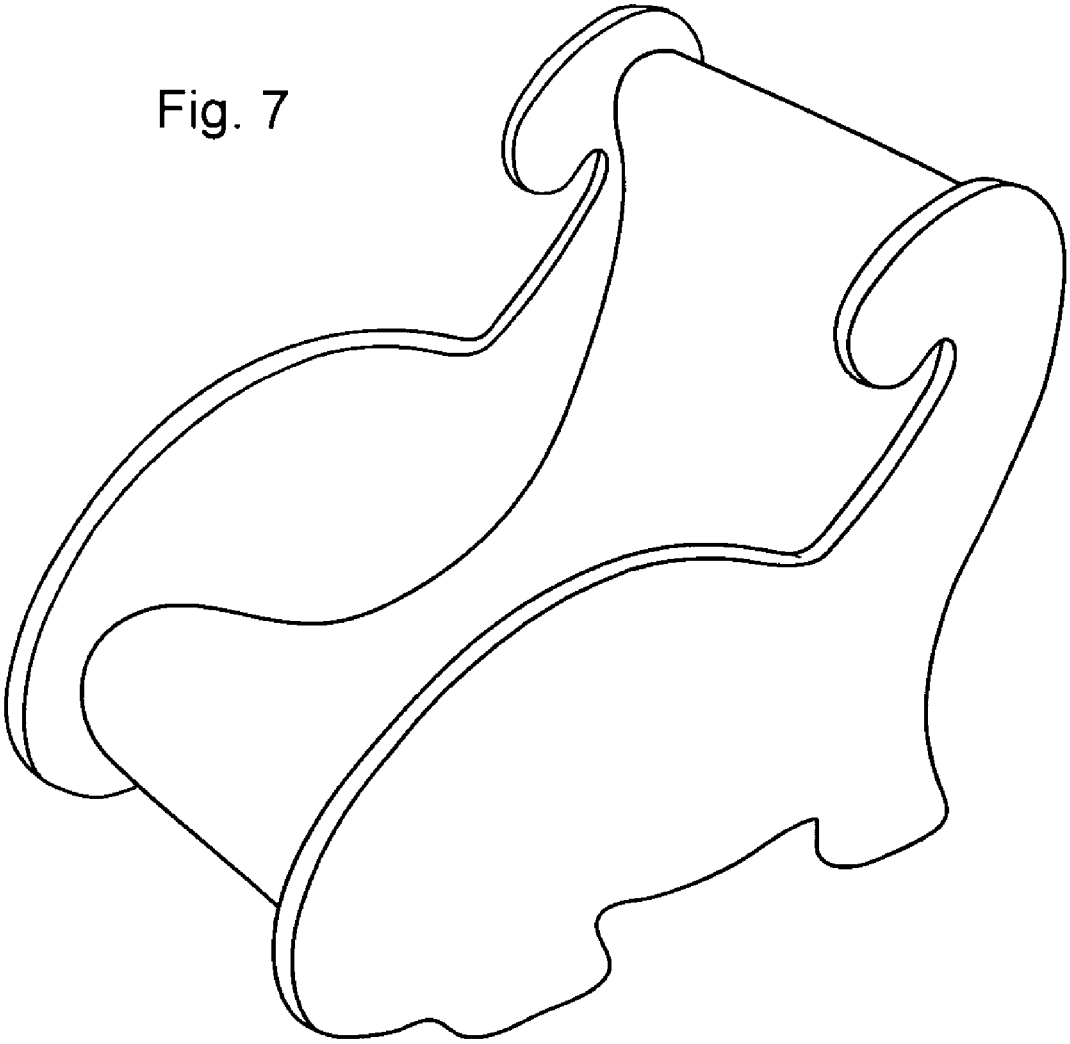
FIG. 7 is a perspective view of a straight chair frame with a removable sling loop.

FIG. 1 is an illustration of a chair frame, generally 10, representative of the present invention. Chair frame 10 is for use in constructing a child's rocking chair with the side members having the profile of dinosaurs, whose tails form the rockers. It will be understood, however, that the present invention is also applicable to chairs of other designs, including straight, i.e., non-rocking chairs, such as illustrated in FIG. 7, and chairs designed for adult use. Chair frame 10 is comprised of parallel side members 12 and 14 spaced at a distance approximately equal to the width of the chair seat, parallel horizontal support members 16 and 18 that secure side members 12 and 14 in relation to each other.

Figure 2:
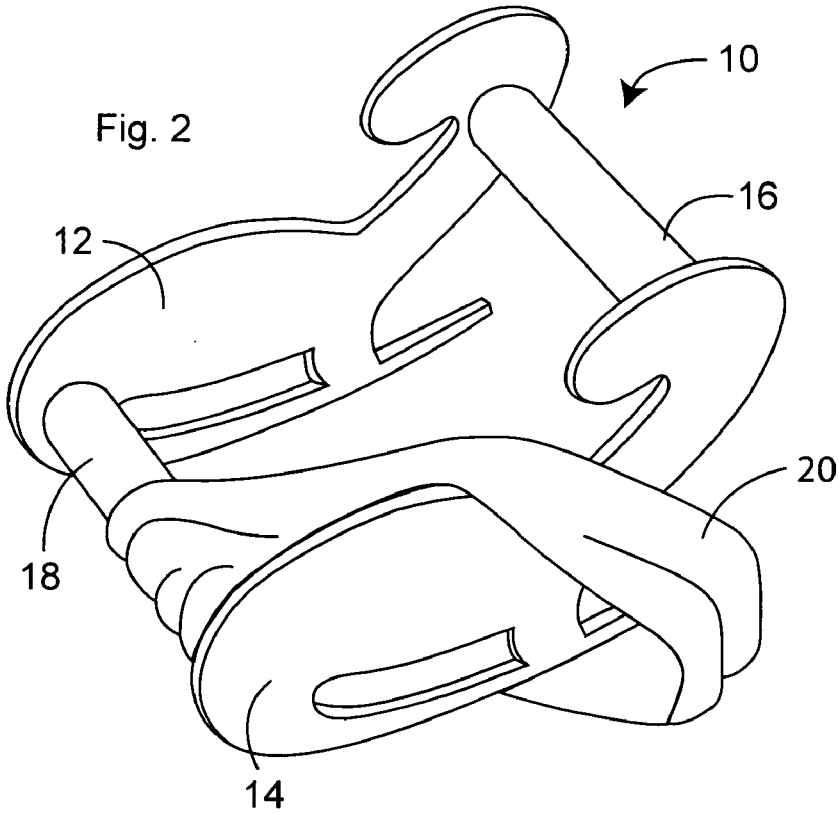
FIG. 2 is a perspective view of a chair frame with the loop pulled over the front of the frame.
Figure 3:
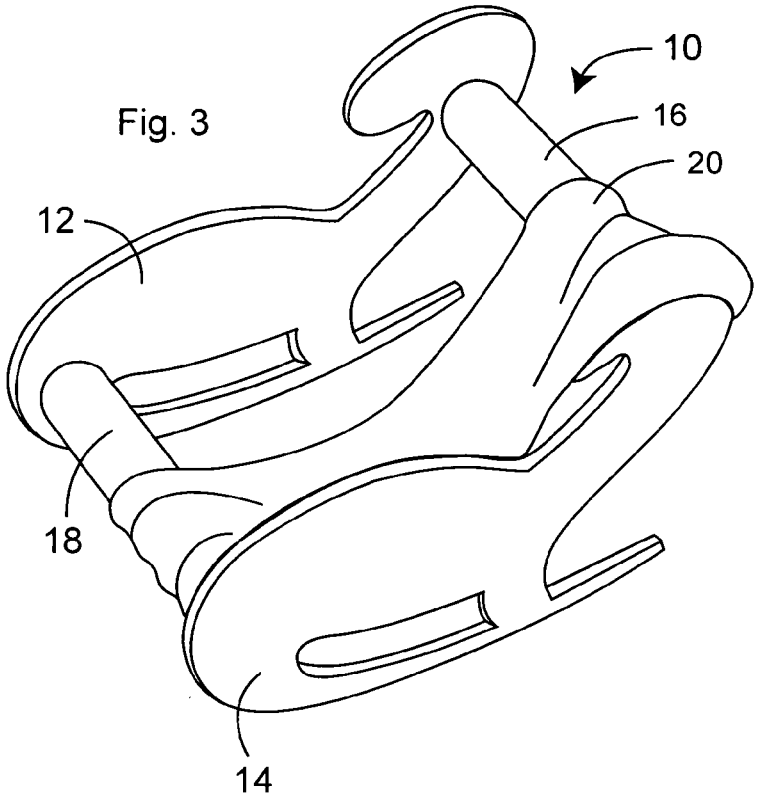
FIG. 3 is a perspective view of a chair frame with the loop pulled over the front and rear of the frame.

FIGS. 2 and 3 illustrate placement of flexible loop 20, which is adapted to extend around support members 16 and 18 between side members 12 and 14. Loop 20 may be formed of any material suitable for a seating surface, e.g., a woven, nonwoven, knitted or other textile fabric, a band of plastic, and the like. Loop 20 may be formed by joining together the opposed ends of a strip of rectangular material. The manner in which the ends are joined will depend on the nature of the material, and may include sewing, heat sealing, etc.

Parallel support members 16 and 18 comprise the sole connections between side members 12 and 14. Preferably, support members 16 and 18 have a circular cross-section so that sling loop 20 can easily slide around members 16 and 18, permitting different segments of the outer surface of loop 20 to be rotated to the top for uniform wear. Each side member 12 and 14 has a front end and a rear end, with the rear end extending upward to form the side of the back of the chair. Support member 16, also referred to as the rear support member, extends between side members 12 and 14 adjacent their upper rear ends, and support member 18, also referred to herein as the front support member, extends between side members 12 and 14 adjacent their front ends.

Figure 4:
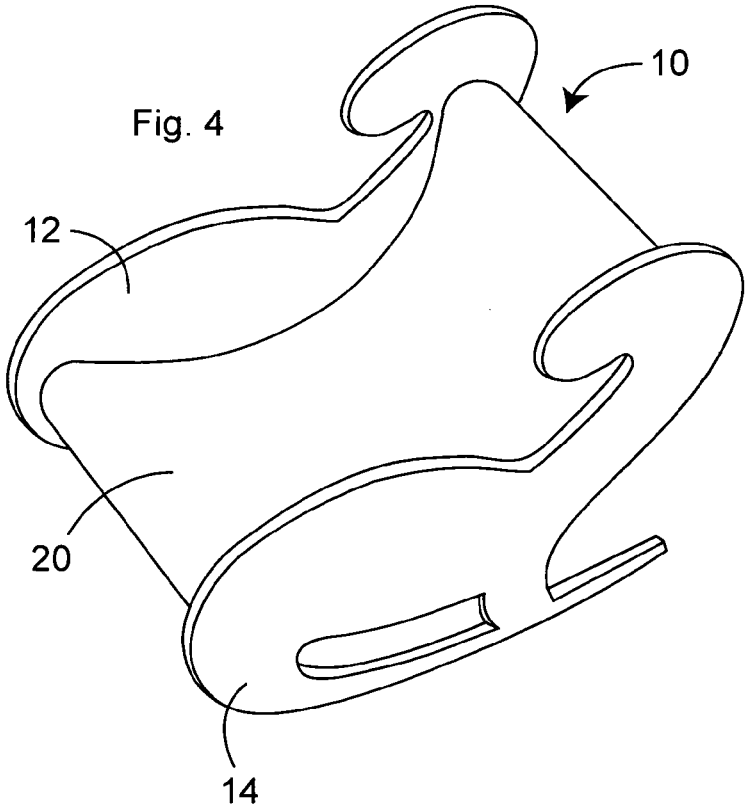
FIG. 4 is a perspective view of the chair frame of FIG. 1 with installed sling loop.

When sling loop 20 is to be placed on the chair frame, loop 20 is first slipped over one end of one of side members 12 or 14, e.g., the front part of one of the side members, to place loop 20 onto one of support members, e.g., support member 18 as shown in FIG. 2. The opposite end of loop 20 is then pulled around the opposite end, e.g., upper rear end of one of side members 12 or 14 to position loop 20 over the other support member, e.g., support member 16 as shown in FIG. 3. Once loop 20 is around support members 16 and 18, the chair is ready for use as illustrated in FIG. 4.

If it is desired to remove loop 20 from the chair, e.g., because loop 20 requires cleaning or simply because the user desires to replace loop 20 with a sling loop of a different color or design, the user pulls the loop taut and slides the loop over an end, e.g., the upper rear end, of one of side member 12 or 14. Once loop 20 has been pulled around an end of a side member, loop 20 is pulled toward the other end of the chair around the side member, pulling loop 20 off of the opposed support member 16 or 18, to separate loop 20 from the chair frame.

Figure 5:
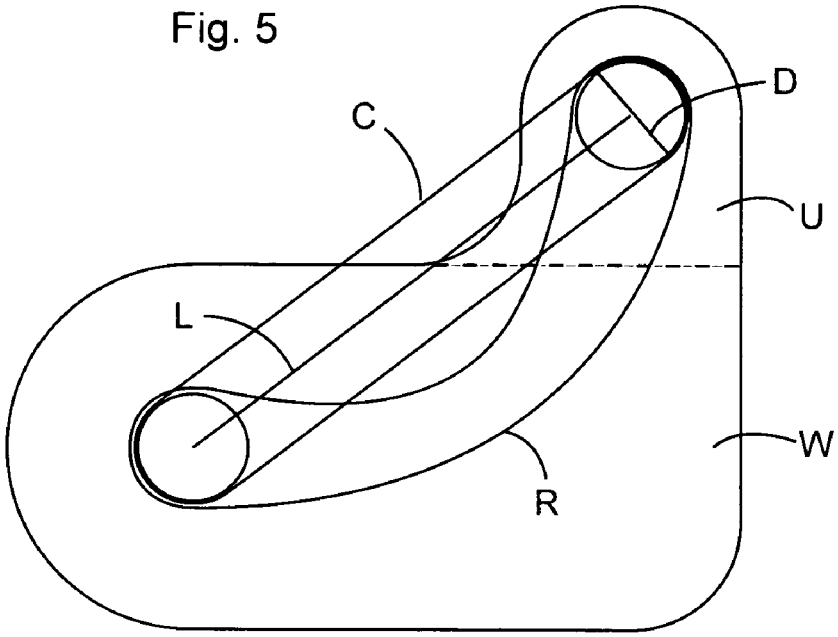
FIG. 5 is a first schematic illustrating the relationship of the frame and loop sizes.
Figure 6:
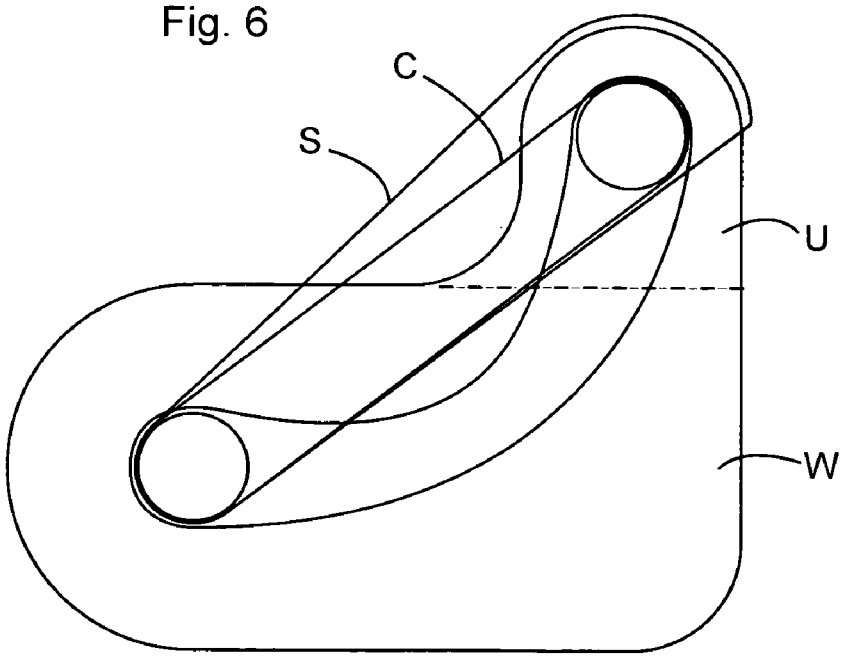
FIG. 6 is a second schematic illustrating the relationship of the frame and loop sizes.

FIGS. 5 and 6 schematically illustrate the dimensions of sling 20 relative to chair frame 10 that are suited for practice of the present invention. As shown, the circumference of loop 20 is greater than twice the distance between support members 16 and 18. Therefore, when loop 20 is placed around support members 16 and 18, loop 20 will sag between members 16 and 18 to take a curved shape, forming the seat and back of the chair.

The circumference of loop 20 is also greater than twice the distance between one of the horizontal support members and the opposed end of the chair, e.g., rear support member 16 and the front end of either of side members 16 or 18. In the illustrated preferred embodiment, the circumference of loop 20 is approximately 3 times the distance between rear support member 16 and the front end of one of the chair side members. While this ratio will vary dependent on the factors discussed in the Summary of the Invention, the loop of many chair designs will be from about 2.5 to about 3.5 times the distance between one of the support members and the opposed end of the chair side member. The width of loop 20 is approximately equal to the distance between the inner faces of side members 12 and 14, and about 25 percent of the circumference of the loop.

It has been determined that the optimal comfort is achieved with a resting sling length R that is from about 1.1 to about 1.3 times greater than the stretch string crossbar length C. Therefore, the stretch string length S must be between about at least 10% to about 30% greater than the stretch string crossbar length C to achieve the desired result.

Side panels 12 and 14 are made of a rigid material and are design agnostic. Any design can be considered so long as it conforms to certain standards related to the optimum stretch string length S as wall as standards of stability. Panels 12 and 14 can be made in any configuration where the upper area of attachment relative to the upper crossbeam allows for a stretch string length that is a minimum of 10–30% greater than the stretch string crossbeam length (see FIG. 6). This allows for optimal seating comfort. Additionally, the upper area U of attachment on the side panel should be less than the lower area W, as shown separated by the horizontal dotted line, ensuring stability of the chair regardless of the side panel configuration.

The following equations may be used in calculating the proper proportions of the side panel and loop. $D\pi+2L=C$ is used to determine the stretch string crossbeam length C. $S \geqq 1.1C$ and $S \leqq 1.3C$ is used to determine the optimum sling length. $A \geqq B$ where B cannot be greater than the relative length of S is used to determine the relative area of the upper side panel U in relation to the stretch string length, where A is the total area of the stretch string length and B is the total area of upper side panel section U and the crossbeam attachments 16 and 18.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A chair having a removable sling seat comprising:

a) a chair frame having spaced, parallel side members with first and second ends, a first horizontal seat support extending between said side members adjacent their first ends, and a second horizontal seat support parallel to said first support extending between said side members adjacent their second ends; and b) a sling seat in the form of a continuous loop extending around said first and second supports and between said side members to form a seating surface, said loop being extendable around said first support and the second end of one of said side members for placement around said supports and removal from said chair frame without separating said loop or detaching said seat supports from a side member.

2. The chair of claim 1, wherein said loop is constructed of a textile fabric.

3. The chair of claim 1, wherein said first seat support is behind and above said second seat support.

4. The chair of claim 1, wherein the second ends of said side members have a curved periphery.

5. The chair of claim 1, wherein said chair is a rocking chair.

6. The chair of claim 1, the circumference of said loop is from about 2.5 to about 3.5 times the distance between said first support member and said side member second end.

7. The chair of claim 1, wherein said loop is reversible.

8. The chair of claim 1, wherein said loop has a width equal to approximately 25 percent of the circumference of said loop.

9. The chair of claim 1, wherein said second end is at the front of said chair.

10. The chair of claim 1, wherein said first end is the upper rear of the chair.

11. The chair of claim 1, wherein said seat supports are the sole connectors between said side members.

12. A rocking chair having a removable sling seat comprising:

a) a chair frame having spaced, parallel side members with rear and front ends, a first horizontal seat support extending between said side members adjacent their rear ends, and a second horizontal seat support parallel to and in a plane below said first support extending between said side members adjacent their front ends, said seat supports being the sole connectors between said side members; and b) a sling seat in the form of a continuous loop extending around said first and second supports and between said side members to form a seating surface, said loop being extendable around said first support and the front end of one of said side members for placement around said supports and removal from said chair frame without separating said loop.

13. The chair of claim 12, wherein said loop is constructed of a textile fabric.

14. The chair of claim 12, wherein said first seat support is behind and above said second seat support.

15. The chair of claim 12, wherein the second ends of said side members have a curved periphery.

16. The chair of claim 12, the circumference of said loop is from about 2.5 to about 3.5 times the distance between said first support member and said side member second end.

17. A chair having a removable sling seat comprising:

a) a fixed chair frame having spaced, parallel side members with rear ends and outwardly curved front ends, a first horizontal seat support extending between said side members adjacent their rear ends, and a second horizontal seat support parallel to and in a plane below said first support extending between said side members adjacent their front ends, said seat supports being the sole connectors between said side members; and b) a sling seat in the form of a continuous loop of textile material extending around said first and second supports and between said side members to form a seating surface, said loop being removable from said chair frame without separating said loop by pulling said loop around the front end of one of said side members for placement while said loop is supported on the first seat support.

18. The chair of claim 17, wherein said seat supports are cylindrical.

19. The chair of claim 17, wherein said chair is a rocking chair.

* * * * *